United States Patent [19]

Arietti et al.

[11] 4,223,655

[45] Sep. 23, 1980

[54] DEVICES FOR REGULATING THE DELIVERY OF FUEL FROM AN INJECTION PUMP TO THE CYLINDER OF AN INTERNAL COMBUSTION ENGINE

[75] Inventors: Giulio Arietti, Turin; Claudio Lombardi, Allessandria, both of Italy

[73] Assignee: Centro Ricerche Fiat S.p.A., Orbassano, Italy

[21] Appl. No.: 9,620

[22] Filed: Feb. 6, 1979

[30] Foreign Application Priority Data

Mar. 9, 1978 [IT] Italy ..... 67503 A/78

[51] Int. Cl.[3] ..... F02D 1/06

[52] U.S. Cl. ..... 123/463

[58] Field of Search ..... 123/140 MP, 140 MC, 123/140 R, 140 FG

[56] References Cited

U.S. PATENT DOCUMENTS 2,562,656 7/1951 Blakeslec ..... 123/140 MP 3,696,798 10/1972 Bishop et al. ..... 123/140 MP 3,981,285 9/1976 Schueler et al. ..... 123/140 MP

FOREIGN PATENT DOCUMENTS 907512 3/1946 France ..... 123/140 MC 530668 12/1940 United Kingdom ..... 123/140 MC

*Primary Examiner*—P. S. Lall

*Attorney, Agent, or Firm*—Sughrue, Rothwell, Mion, Zinn and MacPeak

[57] ABSTRACT

A device regulates the fuel delivery from a fuel injection pump to the cylinder of an internal combustion engine by means of two secondary chambers connected respectively to the induction manifold and Venturi tube, and a main chamber open to the outside, so that pressure variations in the Venturi tube and manifold cause the diaphragms of the respective chambers to move, thereby acting upon mechanical transmission means to control a regulating component of the injection pump.

2 Claims, 2 Drawing Figures

Figure 1:
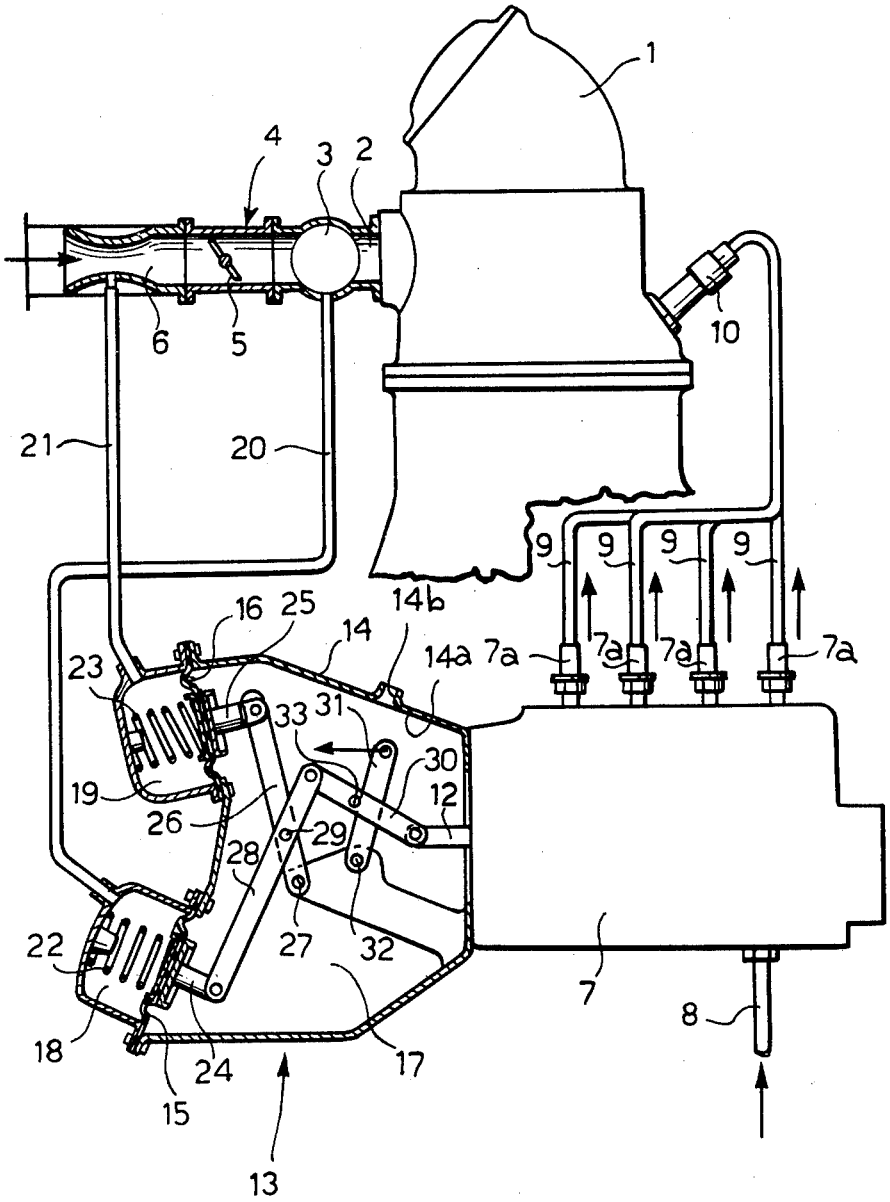

DEVICES FOR REGULATING THE DELIVERY OF FUEL FROM AN INJECTION PUMP TO THE CYLINDER OF AN INTERNAL COMBUSTION ENGINE

The present invention relates to devices for regulating the delivery of fuel fed to the cylinders of an internal combustion engine by a fuel injection pump.

More particularly the invention is concerned with fuel delivery regulating devices for internal combustion engines of the kind having an air induction manifold connected to each engine cylinder and communicating with an air induction pipe upstream of the induction manifold, a throttle valve located within the induction pipe downstream of a Venturi tube, and a fuel injection pump for delivering fuel to the engine cylinders, the injection pump having a regulating component,controlled by the said delivery regulating device, for regulating the fuel delivery of the injection pump.

An object of the present invention is to provide a fuel delivery regulating device of simple construction which is reliable in operation and which will enable regulation of the delivery of the fuel fed by a fuel injection pump to the cylinders of an internal combustion engine in relation to the speed and load of the engine.

According to the present invention there is provided a fuel delivery regulating device for an internal combustion engine of the aforesaid type, characterised in that the device comprises a hollow support body; first and second diaphragms located in the cavity of the support body and fixed peripherally to the inner wall of the latter so as to divide the said cavity into a main chamber and first and second secondary chambers respectively, the said hollow support body having at least one vent aperture connecting the main chamber with the outside; a first pipe connected between the induction manifold and the first secondary chamber; a second pipe connected between the Venturi tube and the second secondary chamber; respective helical coil springs each placed in a respective said secondary chamber and acting, in a direction perpendicular to the respective diaphragm, between the said diaphragm and an inner wall of the respective chamber, and mechanical transmission means between each of the diaphragms and said regulating component for governing the latter in response to variations in pressure in the induction manifold and in the Venturi tube.

Preferably, the mechanical transmission means comprises a pair of supports each fixed to a respective said diaphragm so as to project from the diaphragm into the main chamber, a first lever pivotally mounted on the support body and articulated at one end to the support fixed to the second diaphragm, a second lever pivotally connected to the first lever and articulated at one end to the other support, a third lever articulated at one end to the other end of the second lever and at the other end to the said regulating component, and manually operable means for direct manual regulation of the regulating component.

Preferably the manually operable means for manual regulation of regulating component comprises a fourth lever cooperating with one of the other said levers.

Figure 2:
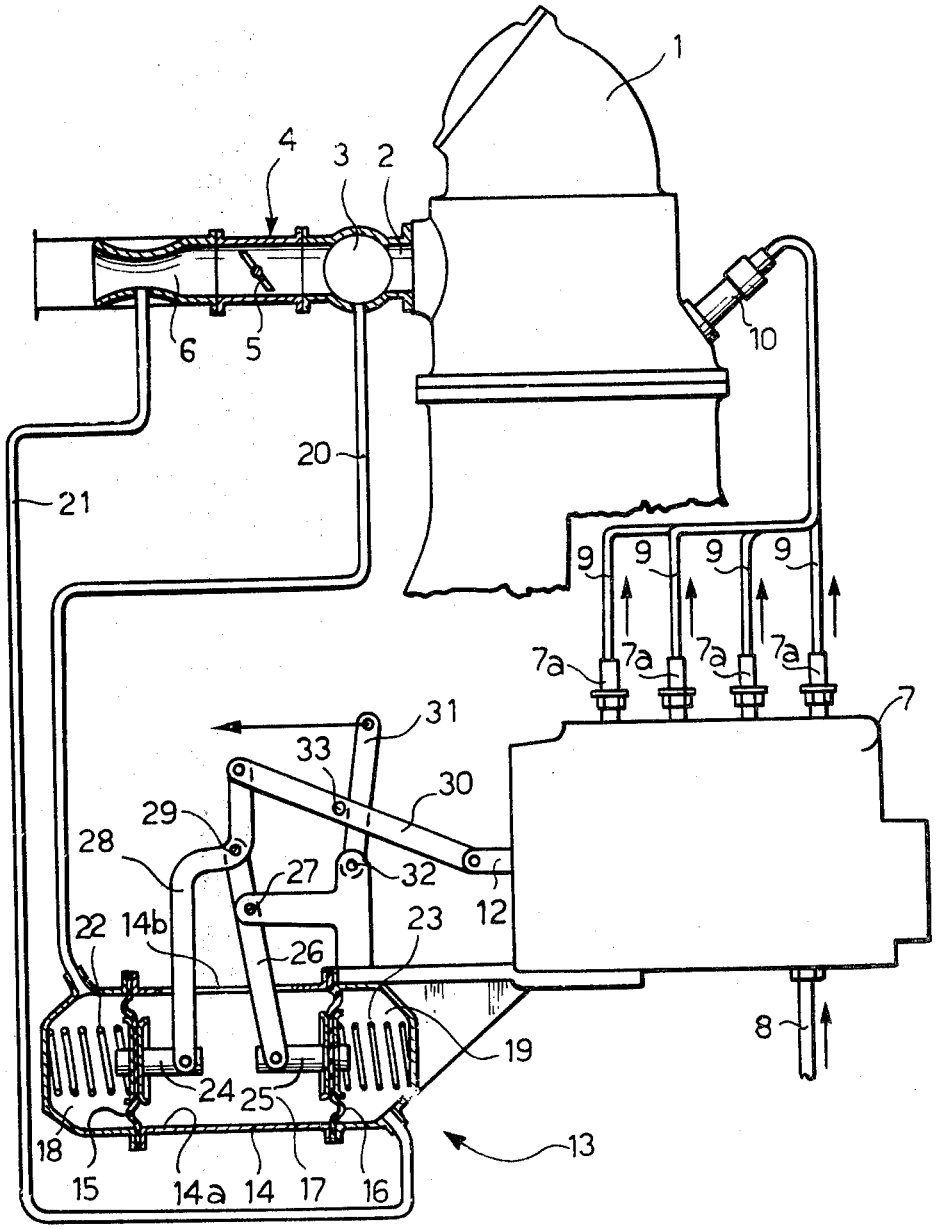

The present invention will now be more particularly described, by way of example, with reference to the accompanying, purely diagrammatic drawings in which:

FIG. 1 shows, partly cut away, an internal combustion engine provided with a fuel delivery regulating device according to the present invention; and FIG. 2 shows a variant of the device of FIG. 1.

Referring now to the drawings, a fuel-injected powdered-ignition internal combustion engine, generally indicated 1, has a plurality of cylinders (not shown) which communicate through respective ducts 2 with an induction manifold 3 for the supply of combustion air. An induction pipe 4 is located upstream of the induction manifold 3 and houses a butterfly throttle valve 5 controlled by known means (not shown). A Venturi tube 6 is fitted to the induction pipe 4 upstream of the throttle valve 5. Upstream of the Venturi tube 6 the induction pipe 4 communicates with an air filter of known type (not shown) through which the air for the engine cylinders passes.

A fuel injection pump 7, of known type, is fed with fuel by a pipe 8 and has a plurality of outlets *7a* which are connected by pipes 9 to respective fuel injectors 10 of the cylinders. In the example shown in FIGS. 1 and 2 there are four outlets *7a*, since the engine 1 has four cylinders.

The fuel injection pump 7 has a regulating component 12 of known type which varies, in known manner, the fuel delivery to the injectors 10 by regulating the delivery of the pump 7.

As shown in FIG. 1 a regulating device, generally indicated 13, for governing the regulating component 12 of the injection pump 7,comprises a hollow support body 14 within the cavity of which are placed first and second diaphragms 15, 16, fixed to the perimeter of the inner wall 14*a* of the body 14 so as to divide the cavity into three chambers; a main chamber 17 and first and second secondary chambers 18, 19. The secondary chambers 18, 19 both lie on the same side of the main chamber 17. The support body 14 has a vent aperture 14*b* connecting the main chamber 17 with the outside.

A first pipe 20 connects the induction manifold 3 with the first secondary chamber 18 and a second pipe 21 connects the Venturi tube 6 with the second secondary chamber 19. Each secondary chamber 18, 19 has a respective helical coil spring 22, 23 extending perpendicularly with respect to the diaphragms 15, 16 so as to be interposed between the respective diaphragms 15, 16 and the inner walls of the respective chambers 18, 19. Each of the diaphragms 15, 16 has a respective support 24, 25 projecting perpendicularly from the respective diaphragms 15, 16 into the main chamber 17. The supports 24, 25 constitute components of mechanical transmission means which further comprises four interconnected, articulated levers 26, 28, 30, 31.

A first lever 26 is articulated at one of its ends to the free end of the support 25 and at its other end is rotatably mounted on a pivot 27 attached to the support body 14. A second lever 28 is articulated at one of its ends to the free end of the support 24 and is rotatably mounted, between its ends, on a pivot 29 attached to the first lever 26. The end of the second lever 28 remote from the support 24 is articulated to one end of a third lever 30, the opposite end of which is articulated to the regulating member 12. A fourth lever 31 is articulated at one end about a pivot 32 attached to the support body 14 and has manual means, not shown, fo effecting rotation of the fourth lever 31 around its pivot 32 in an anti-clockwise direction, according to the drawing. The third lever 30 has a pin 33 between its ends which cooperates with the fourth lever 31 to cause a leftward movement of the third lever 30 as the result of an anticlockwise rotation of the fourth lever 31.

In a variant of the device 13, as shown in FIG. 2 with similar component parts having the same reference numbers as FIG. 1, the secondary chambers 18, 19 are located on opposite sides of the main chamber 17. The first chamber 18 is connected with the induction manifold 3 and the second chamber 19 is connected with the Venturi tube 6. The levers 26, 28, 30, 31 are connected substantially as described above. In this variant, however, the first lever 26 is articulated to the support body 14 by a pivot 27 at a point along its length, the second lever being articulated to the first lever 26 by the pivot 29 at the remote end of the first lever 26.

The regulating device 13 shown in FIG. 1 operates as follows:

the first diaphragm 15 is subjected on its surface turned towards the main chamber 17 to a pressure equal to atmospheric pressure, and on its surface turned towards the first secondary chamber 18 to a pressure equal to the pressure existing in the induction manifold 3 plus the pressure due to the load of the spring 22. Thus, the diaphragm 15 is continuously in a position of equilibrium with respect to the forces acting on its opposite surfaces.

When the throttle valve 5 is opened the absolute pressure in the induction manifold 3 increases causing the diaphragm 15 to move towards the main chamber 17, consequently inducing, by means of the second lever 28,a leftward movement of the regulating component 12 of the injection pump 7 and a resulting increase in the quantity of fuel injected into each cylinder of the engine 1 during each cycle.

In this case, in fact, the first lever 26 is fixed, assuming the second diaphragm 16 and the support 25 to be fixed, hence, the second lever 28 rotates about the pivot 29 on the first lever 26. The second diaphragm 16, however, is subjected on one surface to the ambient pressure existing in the main chamber 17 and on the other surface to the pressure existing in the Venturi tube 6 plus the pressure due to the load of the spring 23. Thus, in each operating condition the second dipahragm 16 is in a position of equilibrium with respect to the forces acting on its opposite surfaces.

When the induction of air through the Venturi tube 6 increases, the pressure present in the second chamber 19 is reduced causing the second diaphragm 16 to move towards the second secondary chamber 19. This causes an anticlockwise rotation of the first lever 26 about the pivot 27, so that the second lever 28 also rotates in an anticlockwise direction around the pivot on the support 24. Consequently, a leftward movement of the regulating component 12 of the injection pump 7 is induced to increase the quantity of fuel injected into each cylinder of the engine 1 in each cycle.

If, when the throttle valve 5 is fully open, the quantity of fuel which is injected in each cycle into each cylinder of the engine 1 is insufficient, then one can act manually upon the direct control, the fourth lever 31, to induce further leftward movement of the regulating component 12 in order to increase further the amount of fuel injected.

It will be appreciated that the manual control, the fourth lever 31, instead of acting on the third lever 30, could be arranged to act on one of the other levers 26, 28 of the transmission means or alternatively could act directly upon the regulating component 12 itself.

The variant of the device shown in FIG. 2 has a similar operation to that described with reference to FIG. 1.

What is claimed is:

1. In an internal combustion engine comprising, in combination:

a plurality of cylinders;

an air induction manifold communicating with each said cylinder;

an air induction pipe upstream of said air induction manifold;

a throttle valve located within said induction pipe;

means for controlling said throttle valve;

a Venturi tube fitted to said induction pipe upstream of said throttle valve;

a fuel injection pump having a regulating component for regulating the fuel delivery of the pump;

means for feeding fuel to said fuel injection pump, and means for delivering fuel from said injection pump to said cylinders:

a fuel delivery regulating device comprising:

a hollow support body;

first and second diaphragms located in the cavity of said hollow support body and fixed peripherally to the inner wall of said body;

a main chamber defined within said body;

a first secondary chamber within said body and divided from said main chamber by said first diaphragm;

a second secondary chamber within said body and divided from said main chamber by said second diaphragm;

vent aperture means connecting said main chamber with the outside;

a first pipe connected between said induction manifold and said first secondary chamber;

a second pipe connected between said Venturi tube and said second secondary chamber;

a pair of helical coil springs, each placed in a respective said secondary chamber and acting, in a direction perpendicular to a respective said diaphragm and the wall of a respective said secondary chamber; and mechanical transmission means between each of said diaphragms and said regulating component, whereby said regulating device governs said regulating component in response to variations in pressure in said induction manifold and in said Venturi tube, said mechanical transmission means comprising:

first and second supports fixed to the first and second diaphragms respectively so as to project from said diaphragms into said main chamber;

a first lever pivotally mounted on said hollow support body and articulated at one end to said second support;

a second lever pivotally mounted to said first lever and articulated at one end to said first support;

a third lever articulated at one end to the other end of said second lever and at the other end to said regulating component, and manually operable means for direct manual regulation of said regulating component, said manually operable means comprising a fourth lever pivotally mounted to said support body and cooperating with one of the other said levers.

2. A device as defined in claim 1, wherein said secondary chambers both lie on the same side of said main chamber.

* * * * *